US007383652B2

(12) United States Patent
Glasberg

(10) Patent No.: US 7,383,652 B2
(45) Date of Patent: Jun. 10, 2008

(54) STATIONERY ACCESSORY SYSTEM

(75) Inventor: Evan Glasberg, Sharon, MA (US)

(73) Assignee: Fastrack LLC, Sharon, MA (US)

( * ) Notice: Subject to any disclaimer, the term of this patent is extended or adjusted under 35 U.S.C. 154(b) by 294 days.

(21) Appl. No.: 10/941,348

(22) Filed: Sep. 15, 2004

(65) Prior Publication Data

US 2005/0225075 A1 Oct. 13, 2005

Related U.S. Application Data

(63) Continuation-in-part of application No. 10/821,305, filed on Apr. 9, 2004, now abandoned.

(51) Int. Cl.
*B42F 21/00* (2006.01)
*G09F 23/10* (2006.01)

(52) U.S. Cl. ..... 40/641; 40/360; 40/359

(58) Field of Classification Search ..... 40/641, 40/360, 628, 359; 229/67.1, 67.2
See application file for complete search history.

(56) References Cited

U.S. PATENT DOCUMENTS

| | | | | |
|---|---|---|---|---|
| 4,079,533 | A | 3/1978 | Rohner | |
| 4,766,656 | A | 8/1988 | Gutowski | |
| 5,540,513 | A | 7/1996 | Wyant | |
| 5,707,001 | A * | 1/1998 | Mark et al. | 229/67.2 |
| 5,901,982 | A * | 5/1999 | Cooper | 281/31 |
| 6,042,291 | A | 3/2000 | Ho et al. | |
| 6,209,778 | B1 | 4/2001 | Henrikson et al. | |
| 6,332,285 | B1 * | 12/2001 | Aaldenberg et al. | 40/641 |
| 6,594,933 | B2 | 7/2003 | Attia et al. | |
| 2003/0126779 | A1 * | 7/2003 | Sato et al. | 40/641 |
| 2005/0093290 | A1 * | 5/2005 | Richied | 283/36 |

FOREIGN PATENT DOCUMENTS

| | | | |
|---|---|---|---|
| DE | 15 36 665 | A1 | 4/1970 |
| DE | 25 46 634 | A1 | 4/1977 |
| DE | 3312789 | C1 | 6/1984 |
| DE | 3936728 | A1 * | 5/1991 |
| FR | 1031393 | A | 3/1953 |
| FR | 1387346 | A | 12/1964 |
| GB | 2021046 | A | 11/1979 |
| GB | 578 172 | A | 2/2000 |
| JP | 10 217664 | A | 8/1998 |
| JP | 2000 52681 | A | 2/2000 |
| JP | 2000052681 | A * | 2/2000 |

* cited by examiner

*Primary Examiner*—Cassandra Davis
(74) *Attorney, Agent, or Firm*—Mark S. Leonardo; Brown Rudnick Berlack Israels LLP

(57) ABSTRACT

A stationery accessory system comprises a slidable tab including indicia of contents contained in or demarcated by the stationery accessory system and a sheet-like member including a rail; one of the slidable tab and the rail having a channel defined along a longitudinal aspect thereof, the channel defined by a wall of the rail, and the channel having a longitudinal opening narrower than a width interior to the channel measured parallel to the longitudinal opening; and the other of the slidable tab and the rail having an expanded edge, the expanded edge having a width greater than the longitudinal opening such that the channel and the expanded edge are slidably engageable.

23 Claims, 12 Drawing Sheets

STATIONERY ACCESSORY SYSTEM

BACKGROUND OF INVENTION

The present invention relates to stationery items, such as file folders and loose-leaf dividers, report dividers or organizers having tabs. The invention relates to folders of the hanging type, as well as loose filing folders.

Conventional hanging folders 101 have plastic tabs 102 that can be positioned in plural, discreet positions along a top edge of the folder, as shown in FIG. 1. In conventional usage, shown in FIG. 2 hanging folders 101 are arrayed in a row, one behind the other, within a file drawer 201 having suitable supports 202. The plastic tabs 102 have wing portions 103 that are inserted into slots 104 disposed at each of the discrete positions. In order to make the tabs on folders further back in the file drawer visible, most users of such files stagger the positioning of the tabs for example in a sequence from left to right that repeats every three or five folders, or the like, as shown in the front portion 203 of the drawer 201 of FIG. 2. However, when the files need to be repositioned or when files need to be added or deleted from a file drawer, the pattern with which the tabs had previously been staggered is disrupted, leaving one or more tabs 205 further forward in the drawer, possibly obscuring one or more of the tabs 206 further back in the drawer, as shown in the back portion 204 of the drawer 201 of FIG. 2. The user must then remove the plastic tabs from positions at which they have been placed, and they must then be reattached to hanging folders at new positions, re-establishing the desired staggered pattern.

Conventional loose filing folders such as manila folders are often used to create sub-files, also referred to as inside folders, within hanging folders, or may be used in loose filing drawers or boxes of their own. Manila folders 301 are conventionally precut, usually with each having a tab at one of three or five staggered positions 302 along a top edge 303, as shown in FIG. 3. By selecting a sequence of folders where the tabs of one folder do not overlap the tab of an immediately succeeding folder, the tabs of each succeeding folder are made relatively more visible, as shown in the front portion 401 of the drawer of FIG. 4. However, as with the hanging folders, when the filing system must be updated, or when individual file folders are replaced or changed the staggered pattern may be disrupted as shown in the back portion 402 of the drawer of FIG. 4. Again, a tab 403 further forward in the drawer may obscure a tab 404 further back in the drawer. Because the manila folders do not have repositionable/adjustable tabs, they are frequently discarded when changing the filing system or when the file tabs become damaged or tattered. In some cases adhesive labels may be applied over the tabs and new markings then made. While discarding manila folders that now have tabs in the wrong positions due to a rearrangement of the filing system is wasteful, re-labeling and reusing folders is difficult and sloppy.

What is needed is an improved tab system for file folders, hanging file folders, loose-leaf dividers, report dividers, organizers and the like.

SUMMARY OF INVENTION

According to aspects of an embodiment of the invention, a stationery accessory system comprises: a slidable tab; and a sheet-like member including a rail; one of the slidable tab and the rail having a channel defined along a longitudinal aspect thereof, the channel defined by a wall of the rail, and the channel having a longitudinal opening narrower than a width interior to the channel measured parallel to the longitudinal opening; and the other of the slidable tab and the rail having an expanded edge, the expanded edge having a width greater than the longitudinal opening such that the channel and the expanded edge are slidably engageable. In one variation of this embodiment, the rail is integral with the sheet-like member. In another variation the rail is permanently affixed to the sheet-like member. In yet another variation, the rail is removably affixed to the sheet-like material. In variations having an integral rail, the sheet-like member may comprise an extruded polymeric material. In variations having an extruded polymeric material, the rail may be a polymeric material co-extruded with the sheet-like member. According to any of these variations, the sheet-like member may comprise the top of or a wall of the file folder, hanging folder, notebook divider or organizer. According to aspects of another embodiment of the invention, a method of making a stationary accessory comprises: extruding a length of sheet material having a rail along one edge thereof; extruding a length of tab material; dividing the length of tab material into individual tabs; and dividing the length of sheet material into individual sheets; wherein one of the tab and the rail have a channel defined along a longitudinal aspect thereof, the channel defined by a wall of the rail, and the channel having a longitudinal opening narrower than a width interior to the channel measured parallel to the longitudinal opening; and the other of the tab and the rail having a beaded edge, the bead having a width greater than the longitudinal opening such that the channel and the expanded edge are slidably engageable. The tabs may be interchangeable between the file folder, hanging folder, notebook divider or organizer. The tabs may be produced in varying lengths, sizes, shapes and colors enabling the user flexibility in developing their own filing system. Although useable in a system, together with file folders, hanging folders, notebook dividers, organizers or the like, the tabs are a separate and distinct component. According to a variation of this embodiment, extruding the length of sheet material comprises co-extruding the length of sheet material and the rail. According to another variation of this embodiment, the method further comprises affixing the rail to the extruded length of sheet material. Affixing may further comprise permanently attaching the rail or releasably attaching the rail.

An accessory for a sheet-type stationery item comprises a slidable tab, wherein the tab is configured to slidably engage with an edge of the stationery item. The edge of the stationery item may include a rail for engaging with the tab.

A stationery system comprises a sheet-type stationery item having an edge facility thereof for slidably engaging with a tab for identifying the stationery item.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
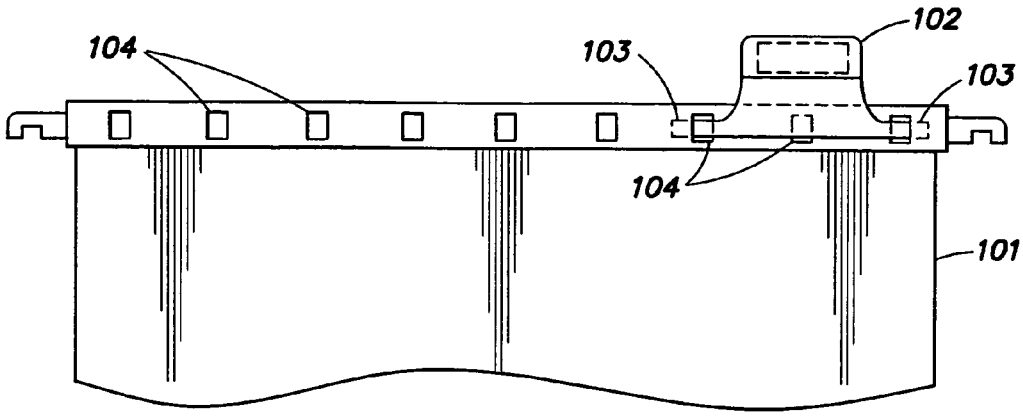
FIG. 1 (Prior Art)
FIG. 1 is a detailed view of the slot and tab attachment feature of a conventional hanging folder.
Figure 2:
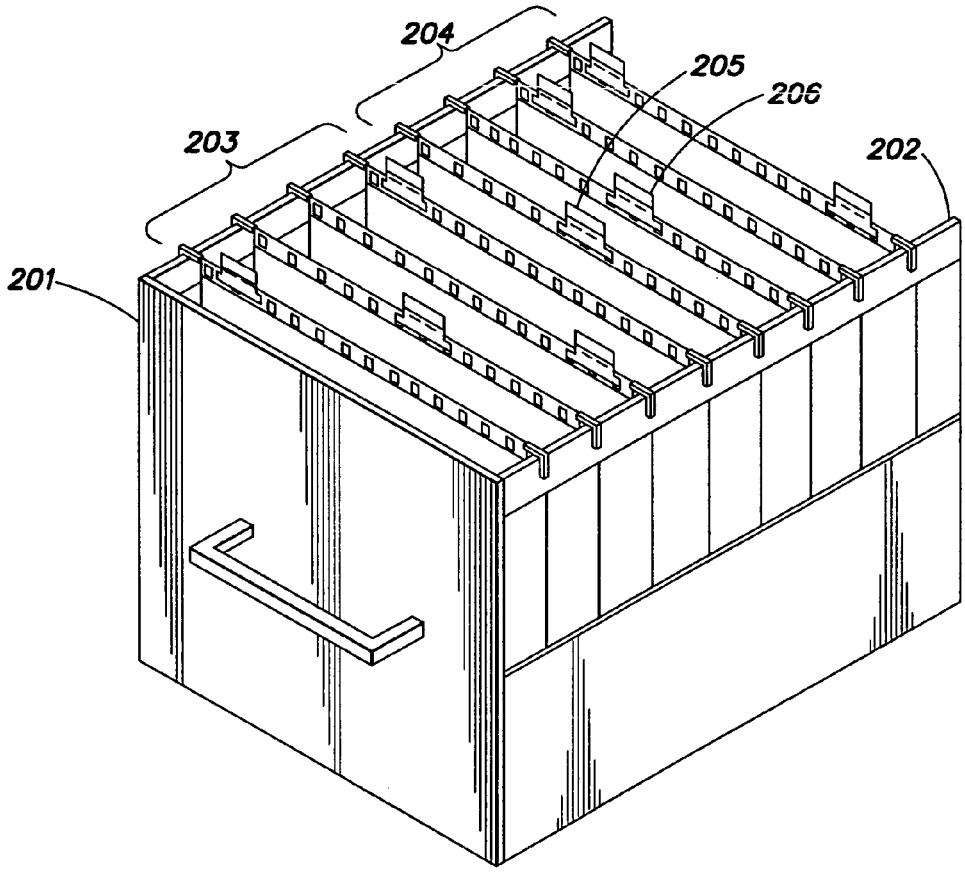
FIG. 2 (Prior Art)
FIG. 2 is a perspective view of conventional hanging folders stored in a row.
Figure 3:
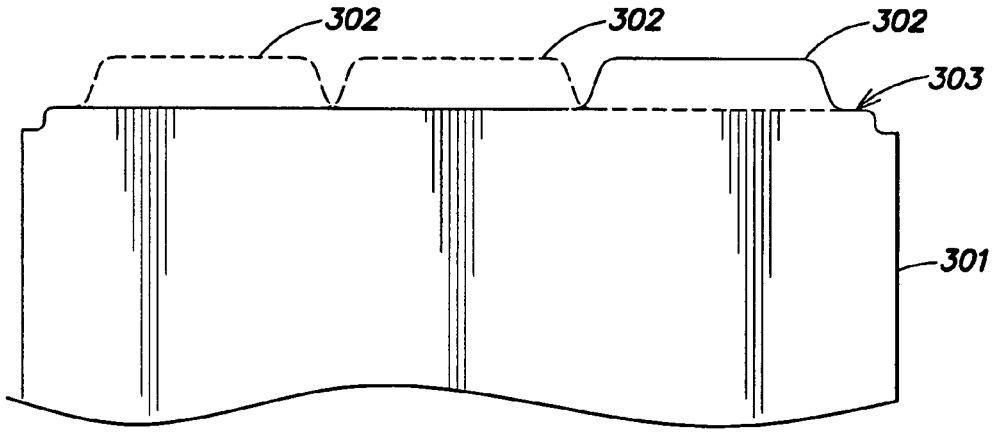
FIG. 3 (Prior Art)
FIG. 3 is a detailed view of a conventional manila folder tab.
Figure 4:
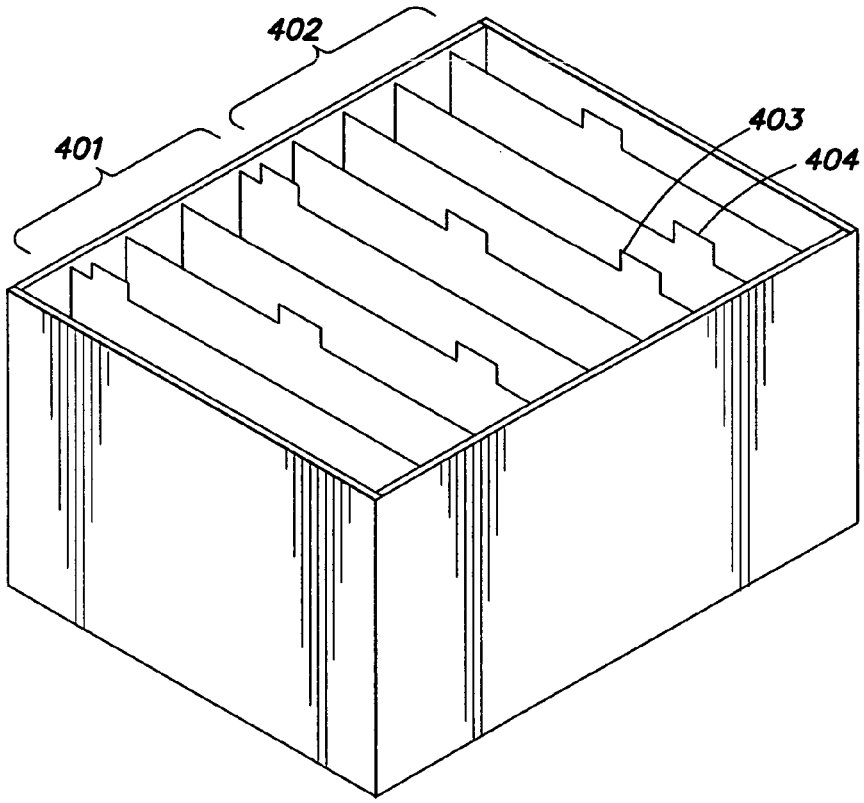
FIG. 4 (Prior Art)
FIG. 4 is a perspective view of conventional manila folders stores in a row.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Various aspects of exemplary embodiments of the present invention are now described in connection with FIGS. 5-14. These embodiments include a tab and a sheet-like member to which the tab attaches. The tab and sheet-like member have a slidably engageable construction including a channel formed in one and a corresponding projecting rim, lip or bead formed in the other. The tab is slidable from one extreme position at or near one end of the sheet-like member to another extreme position at or near the other end of the sheet-like member. The position of the tab is preferably infinitely adjustable between the two extreme positions. In addition to the infinite adjustability between the two extreme positions, the construction may include detent positions or high friction positions that tend to hold the tab in such preferred or predetermined positions along the track.

The features of the exemplary embodiment are now described in connection with FIGS. 5-14.

Figure 5:
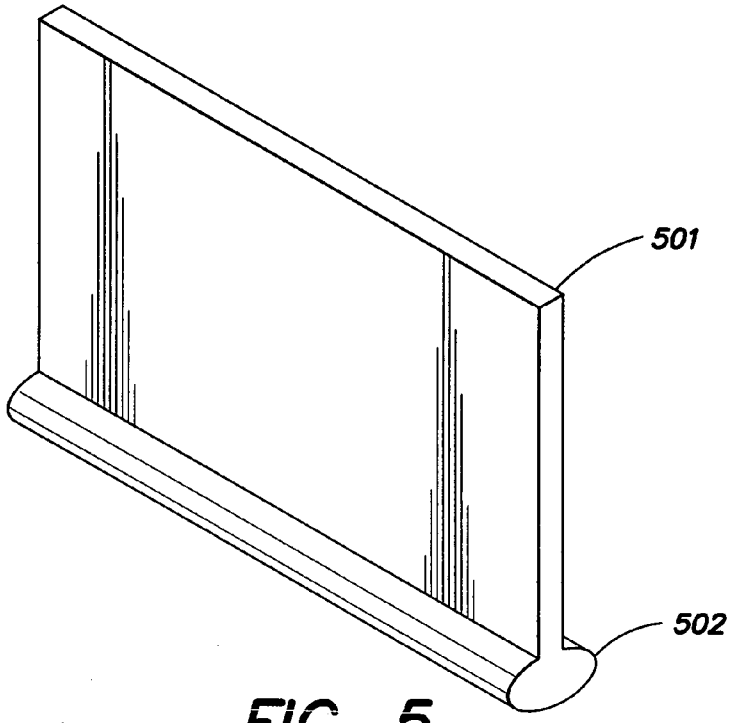
FIG. 5 is a perspective view of an adjustable tab with a bead at the base of the tab.

According to aspects of one embodiment of the invention shown in FIG. 5, a tab 501 has an enlarged feature, referred to hereinafter without loss of generality as a bead 502, disposed along a lower edge. As will be explained below, bead 502 engages with a channel constructed in a stationery article to receive bead 502. The bead may be constructed in any suitable configuration or design that facilitates its slideability and strength along the channel.

Figure 6:
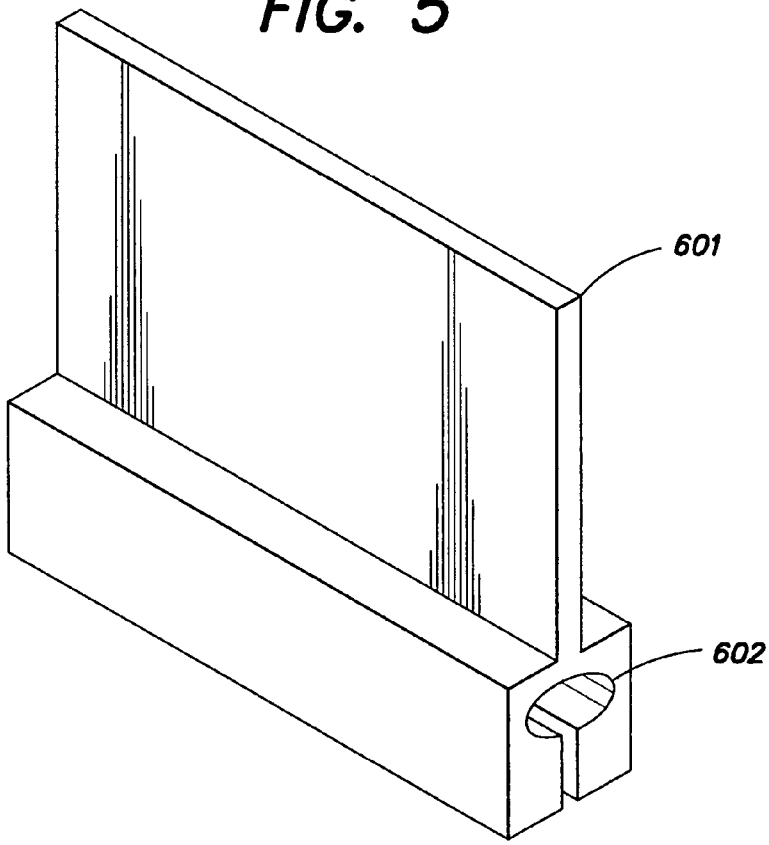
FIG. 6 is a perspective view of an adjustable tab with a channel at the base of the tab.

According to aspects of another embodiment of the invention shown in FIG. 6, a tab 601 has a channel 602 disposed along a lower edge. As will also be explained below, channel 602 engages with an enlarged feature constructed on a stationery article to receive channel 602. The channel may be constructed in any suitable configuration or design that facilitates its slideability and strength along the bead.

Both tabs 501 and 601 may include paper laminated on both sides, for example where the paper has adhesive on at least one side and is affixed to the tab. This material will facilitate writing and creating tab labels. Both tabs 501 and 601 will be constructed at sizes consistent with industry standards, to enable the tabs to fit appropriately in file cabinets, loose-leaf notebooks, and planners.

Figure 7:
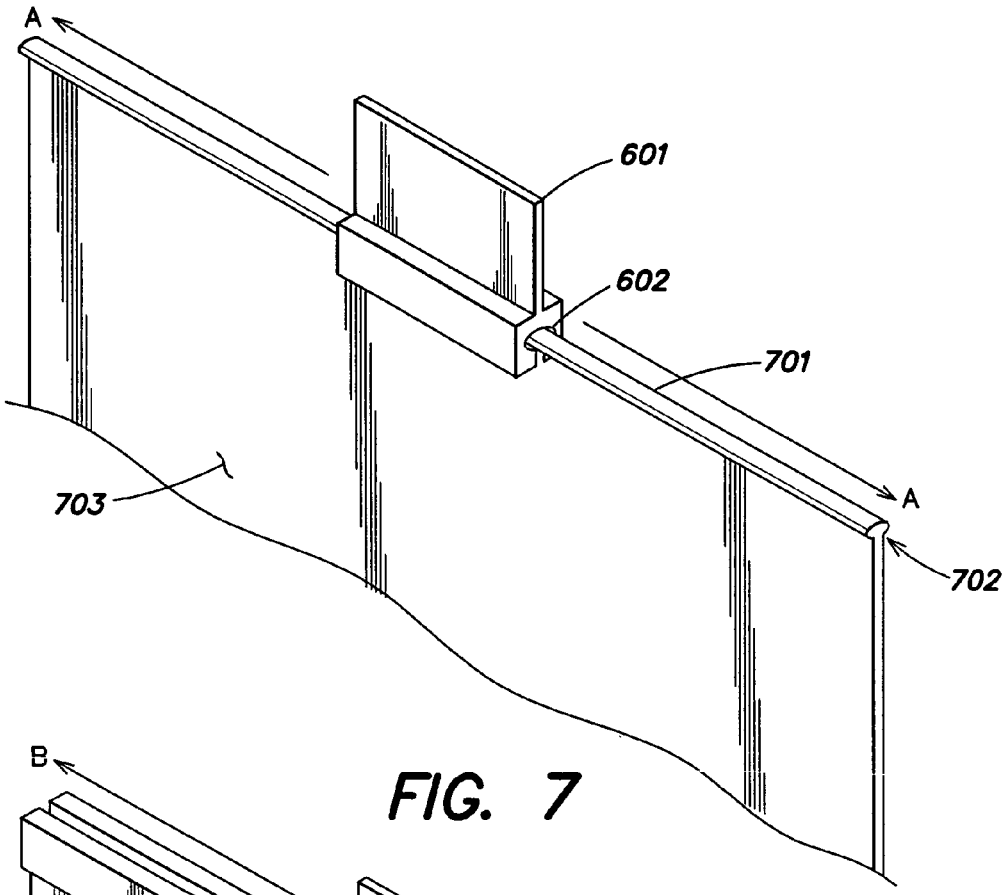
FIG. 7 is a perspective view of a tab slidably mounted to a sheet-like material according to aspects of an embodiment of the invention in which the tab includes a channel at the base of the tab.

As shown in FIG. 7, a tab 601 according to other aspects of the invention rides a track 702 running A-A along an edge of the sheet-like member 703. The sheet-like member 703 may be a file folder, a loose-leaf divider, a report divider, or the like. Track 702 includes an enlarged feature 701 which is engaged by the channel 602 of tab 601. The enlarged feature 701 is hereafter referred to as a bead 701, without loss of generality to other forms of projecting rim or lip.

Figure 8:
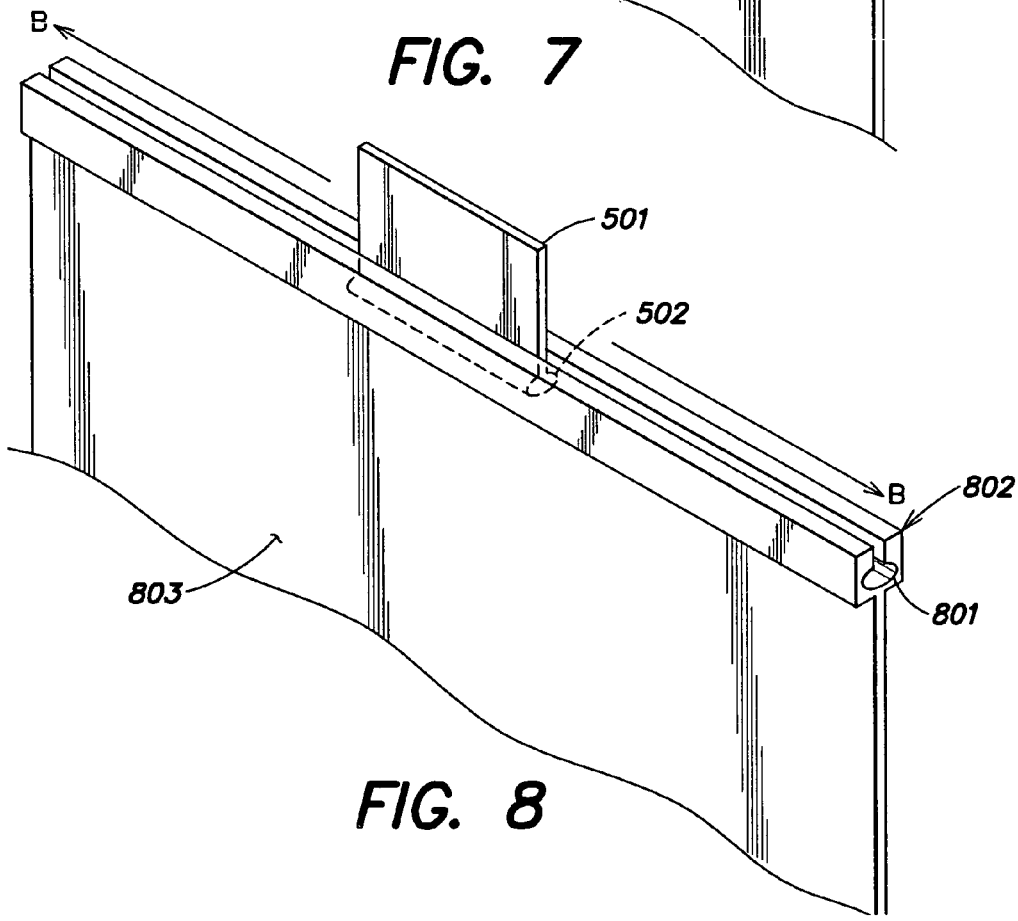
FIG. 8 is a perspective view of a tab slidably mounted to a sheet-like material according to aspects of an embodiment of the invention in which the tab includes a bead at the base of the tab.

As shown in FIG. 8, a tab 501 according to aspects of the invention rides a track 802 running B-B along an edge of the sheet-like member 803. The sheet-like member 803 may be a file folder, a loose-leaf divider, a report divider, or the like. Track 802 includes a channel 801 which is engaged by the bead 502 of tab 501.

Both sheet-like member 703 and 803 can be constructed to have sizes consistent with industry standards, including but not limited to, letter and legal sizes.

Figure 9:
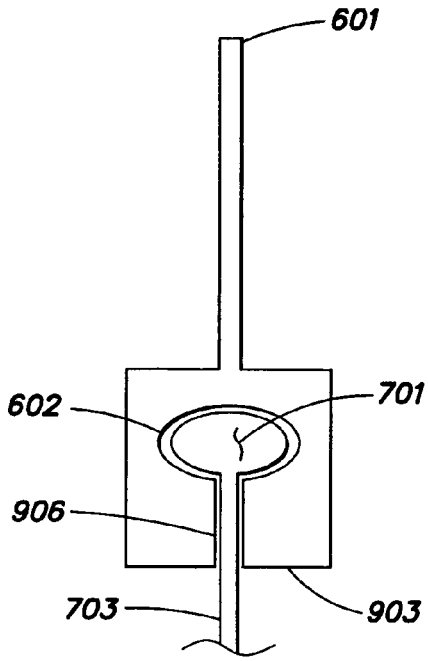
FIG. 9 is a detailed view of a slide element according to aspects of the embodiment of the invention.

The detail of FIG. 9 shows aspects of one embodiment of the tab and track configuration. In this embodiment, the tab 601 includes a channel 602 along a bottom edge 903, thereof. The track, or rail, has a projecting rim, lip or a beaded or enlarged feature 701 running along the edge of the sheet-like member 703. The channel 602 of the tab 601 engages with the bead 701 of the sheet-like member 703. The channel 602 and bead 701 may engage with a slidable friction fit, or may engage loosely, except at points where detent features hold the tab in place, as explained below. Shoulder contact region 906 defines an opening to the channel 602 that is narrower than the bead 701, so as to retain the bead 701 within the channel 602 against radial forces.

Figure 10:
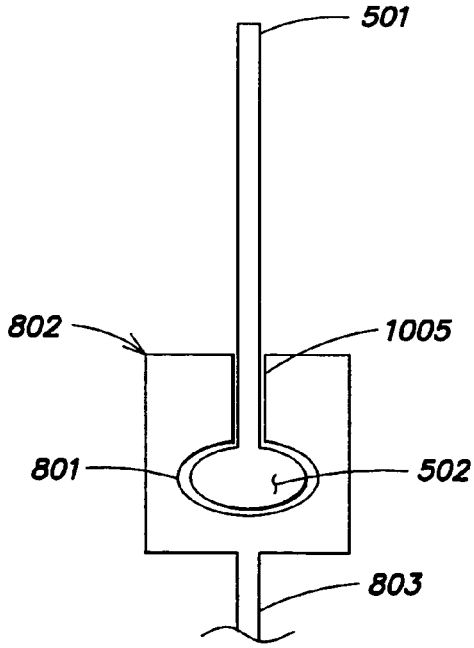
FIG. 10 is a detailed view of another slide element according to aspects of another embodiment of the invention.

According to aspects of an alternative embodiment, as shown in FIG. 10, the tab 501 may have the bead 502 while the track or rail 802 has a channel 801 which engages the bead 502 of the tab 501. Shoulder contact region 1005 defines an opening to the channel 801 that is narrower than the bead 502, so as to retain the bead 502 within the channel 801 against radial forces.

In the embodiments of FIGS. 9 and 10, there should preferably also be a feature that maintains the tab in a vertical or other desired fixed, predetermined angle relative to the sheet-like member. For example, the channel (FIG. 9, 602; FIG. 10, 801) may include a sufficiently broad shoulder contact region (FIG. 9, 906; FIG. 10, 1005) that the tab is maintained at its correct position. Any other suitable feature may be used.

Preferably, the rail runs the entire length of one edge of the sheet-like material, but a shorter rail is also contemplated. The rail should be of a length sufficient to provide substantial mobility of the tab along the edge of the sheet-like member.

Also preferred is either that the channel have a slight flair at the ends or that the bead have a slight taper at the ends thereof so as to facilitate the insertion of the bead into the channel from one end or the other thereof.

Figure 11:
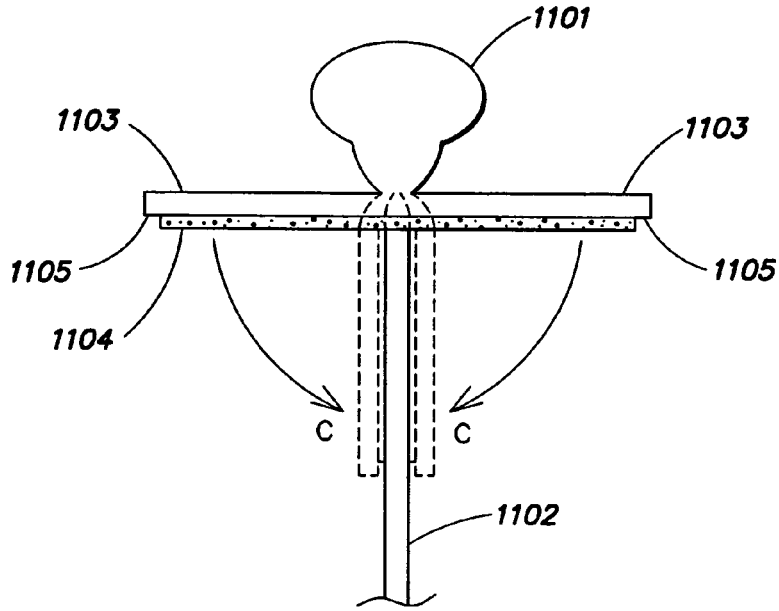
FIG. 11 is a detailed view of an attachment aspect of an embodiment of the invention.

As shown in FIG. 11 the rail 1101 may be a separate component, attached to the sheet-like material 1102, for example adhesively. In this embodiment, the rail 1101 has two wings 1103 coated with an adhesive 1104 on one side 1105 which are then folded down C into contact with the sheet-like material 1102.

Alternatively, in FIG. 11 the rail 1101 may be attached to the sheet-like member with one wing 1103 coated with an adhesive 1104 on one side. In this embodiment of the invention the wing is extruded along with the rail and is an integral part of the rail. The wing may be attached to the inside or outside of the sheet-like material. The wing or wings can serve as handholds when sliding the tab along the rail.

Figure 12:
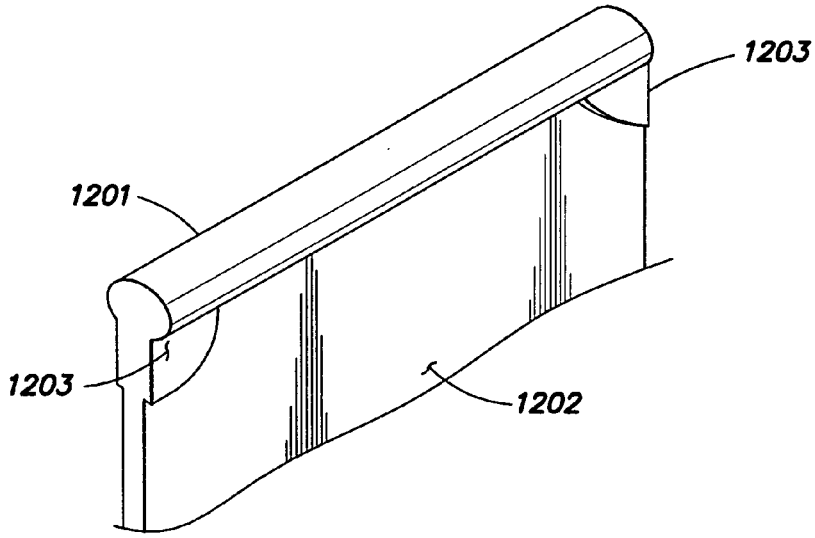
FIG. 12 is a detailed view of an integrated rail according to aspects of yet another embodiment of the invention.

Alternatively, as shown in FIG. 12 the rail 1201 may be fully integrated with the sheet-like material 1202. For example, the sheet-like material and rail can be a single extrusion of a polymeric material. Alternatively, the sheet-like material may be an extruded lamination including a core material, for example, card stock or the like and an outer material, for example an extruded polymer from which the rail is also formed integral with the completed article.

As shown in FIG. 12, there are preferably handholds 1203 or reinforced areas adjacent to the rail that facilitate moving the tab from one side to the other. The user grips a handhold in one hand and the tab in the other and then can slide the tab away from the handhold. The handholds reinforce the area of greatest stress on the rail, so as to also prevent tears during movement of the tab.

Figure 13:
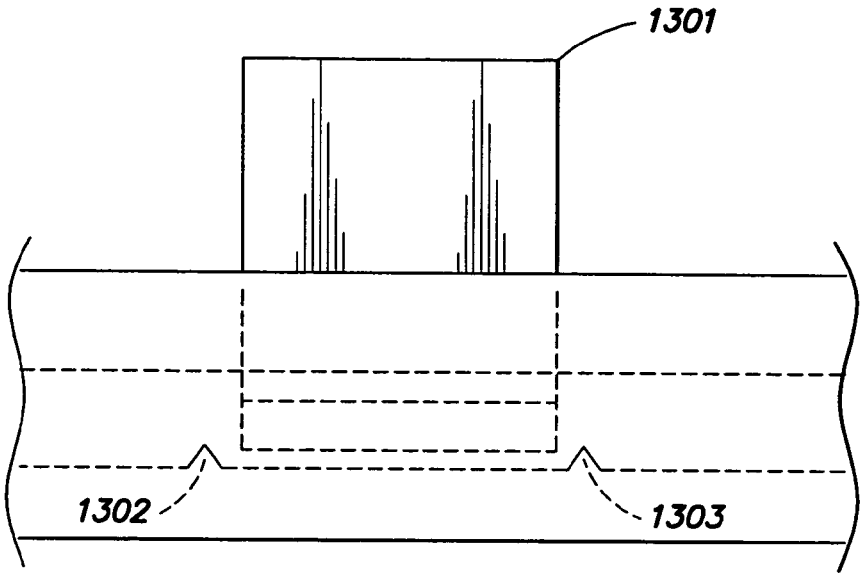
FIG. 13 is a detail showing detents according to aspects of an embodiment of the invention.
Figure 14:
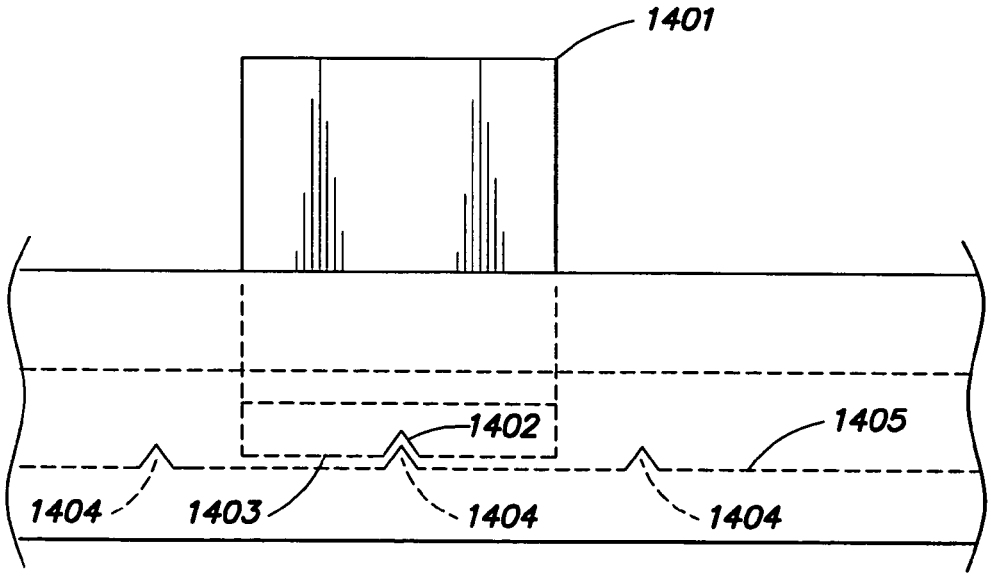
FIG. 14 is a detail showing detents according to aspects of another embodiment of the invention.

Using any suitable technique, the channel or shoulder 1005 may be formed to have detents as shown in FIG. 13 or indents (FIG. 21, 2107) or the channel and rail may be formed with cooperative elements comprising detents as shown in FIG. 14. In the embodiment as shown in FIG. 13, when the tab 1301 is slid to a position between raised portions 1302, 1303, the tab 1301 is then securely held in place by the raised portions 1302, 1303. If it is desired to place the tab 1301 at a position other than the detent location, the tab may be left resting on one of the raised portions also. The detent illustrated in FIG. 14 holds the tab 1401 in place by cooperation between the notch 1402 in the bead 1403 and raised portions 1404 in the channel 1405. As with the detent as shown in FIG. 13 the tab may be positioned other than at a detent position, and left in place, if so desired.

Although no detents are required, if an interference fit is designed, instead, the tolerance of the diameters of the bead and channel can be set so as to prevent tabs from sliding off of the rail or from fitting so tightly as to be difficult to move.

Other variations are also possible. According to aspects of yet another embodiment of the invention, the tab may include at its base a bead having a raised rib positioned crosswise, approximately at the center of the bead. The raised rib would enable the user to select a location for the tab along a predetermined number of slots along the channel. According to aspects of yet another embodiment of the invention, the tab and/or the channel may contain ribs running either longitudinally or crosswise, increasing the friction between the bead of the tab and channel. For example, ribs such as 1302, 1303 of FIG. 13 can be spaced closely together, so as not to form detent positions, but rather to simply locally increase the friction between the tab 1301 and the channel.

The tabs can be of a type to accept inserts, such as conventional paper or paperboard labels. Examples of such tabs are now shown and described in connection with FIGS. 15, 16, 17, 18, 19 and 20. In order to more clearly show certain features, these figures are not to scale.

Figure 15:
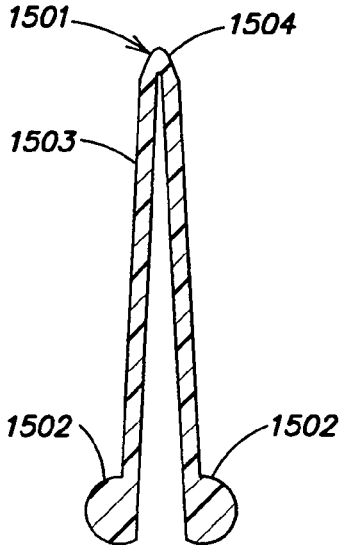
FIG. 15 is a cross sectional view of a bifurcated tab according to aspects of an embodiment of the invention.
Figure 16:
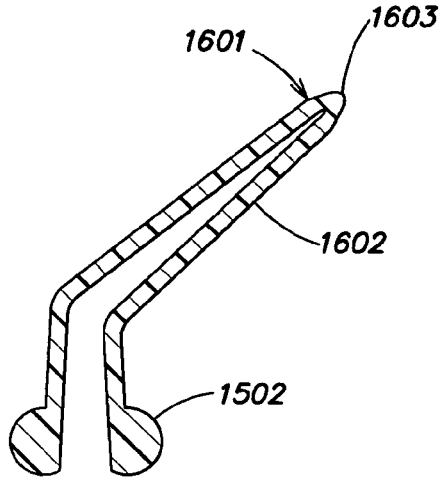
FIG. 16 is a cross sectional view of another bifurcated tab according to aspects of an embodiment of the invention.

The basic configuration, shown in FIGS. 15 and 16, is a tab 1501 having a rail member 1502 and a hollow, transparent upper portion 1503. Label inserts (shown in FIG. 17 in phantom) are inserted and removed from one end or the other of the tab 1501.

FIG. 16 shows a configuration of a tab 1601 whose top portion 1602 resembles a conventional hanging folder tab. Top portion 1602 has a wall which bends back upon itself at a top edge 1603.

Figure 17:
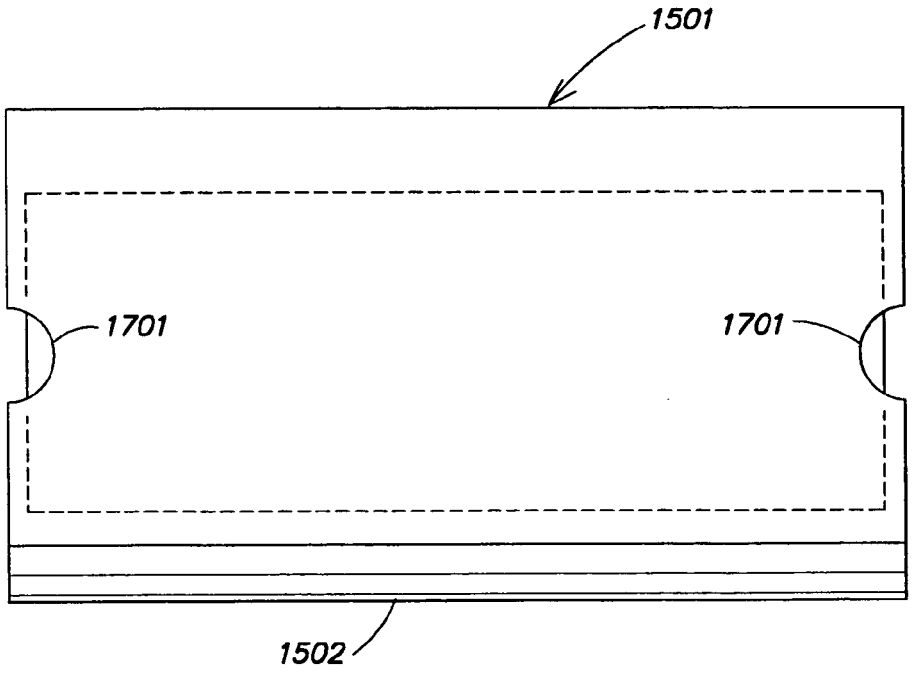
FIG. 17 is a front view of the tab of FIG. 15.

As shown in FIG. 17, in order to facilitate the easy insertion and removal of a label insert, a notch 1701 can be cut into one or both ends of the tab 1501, providing a place where the label insert can be gripped while it is in place in the tab 1501.

Figure 18:
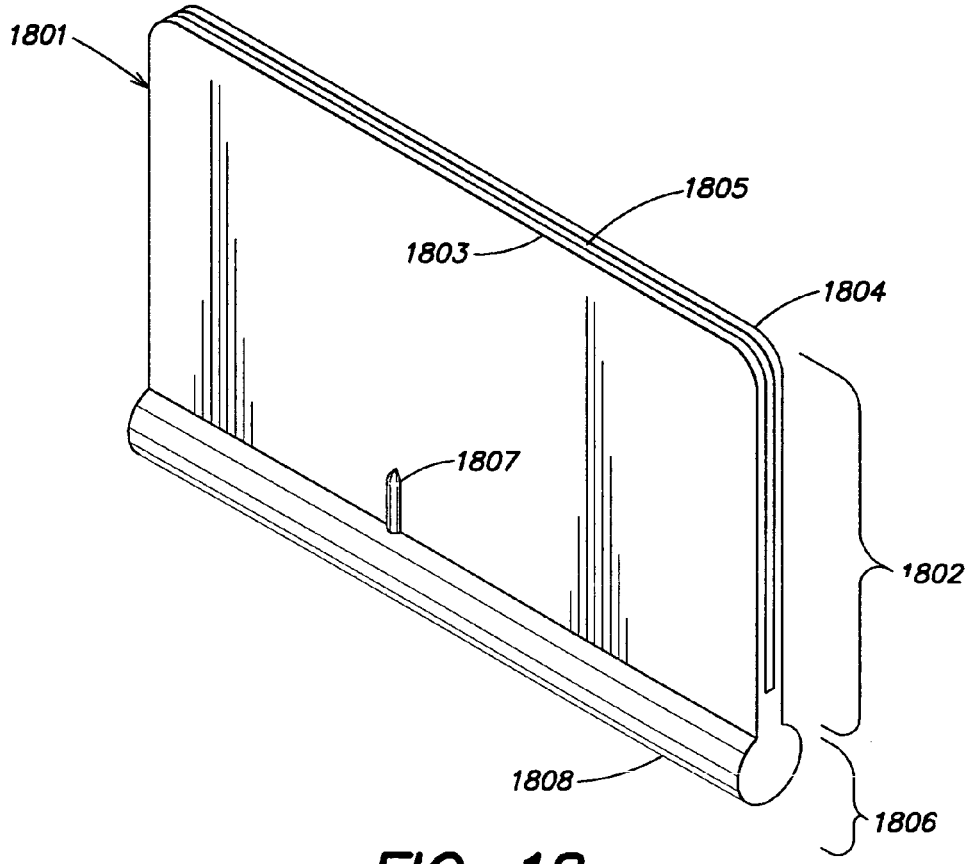
FIG. 18 is a perspective view of another bifurcated tab according to aspects of an embodiment of the invention.
Figure 19:
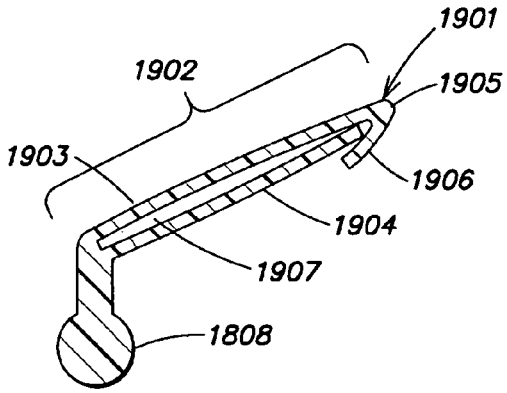
FIG. 19 is a cross sectional view of a closed hollow tab having a clip closure according to aspects of an embodiment of the invention.
Figure 20:
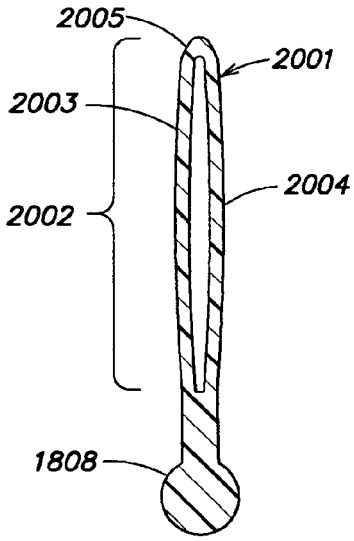
FIG. 20 is a cross sectional view of a closed hollow tab according to aspects of an embodiment of the invention.

Other configurations that may have advantages in ease of manufacture and ease of use are shown in FIGS. 18, 19 and 20.

FIG. 18 shows a configuration of a presently preferred tab 1801. The top portion 1802 of tab 1801 is bifurcated into a front fin 1803 and a back fin 1804 separated by a slot 1805. An insert (not shown) can be slid into the slot 1805, where it is retained by a close fit with the front fin 1803 and back fin 1804. The lower portion 1806 of the tab 1801 includes a rail member 1502. Just above rail member 1502 is a rib feature 1807 that engages detent features (described below in connection with FIGS. 21, 22 and 23) of the track (described below in connection with FIGS. 21, 22 and 23) into which the rail member 1502 is inserted when in use.

FIG. 19 shows a configuration of a tab 1901 having a bifurcated top portion 1902 having a front fin 1903 and a back fin 1904. The top edge 1905 is defined by the front fin 1903 incorporating a bend to form an interlock 1906 with the back fin 1904. The top edge could alternatively be defined by the back fin 1904 incorporating a bend to form an interlock with the front fin 1903. The interlock can reside above, below or over the region of a hollow 1907 defined by the front fin 1903, the back fin 1904 and the top edge 1905, as may be desired by the skilled designer.

As shown in FIG. 20, another configuration of a tab 2001 has a bifurcated top portion 2002 having a front fin 2003 and a back fin 2004, joined at a top edge 2005. In embodiments incorporating this aspect of the invention, the insert may be slid in from one end or the other of the tab 2001. Top edge 2005 may be manufactured as an integral joint, as shown, or may be formed by bonding or adhering the front fin 2003 and back fin 2004 after manufacture.

Any of the tabs shown and described in connection with FIGS. 15, 16, 17, 18, 19 and 20 can include a track as described above in connection with FIG. 6 as an alternative to the rails shown. Also, if the tab includes a track, the track can incorporate various features of any of the tracks described herein, such as detent features.

Some embodiments of tracks for attachment to the sheet members are now described in connection with FIGS. 21, 22 and 23. In order to more clearly show certain features, these figures are not to scale.

Figure 21:
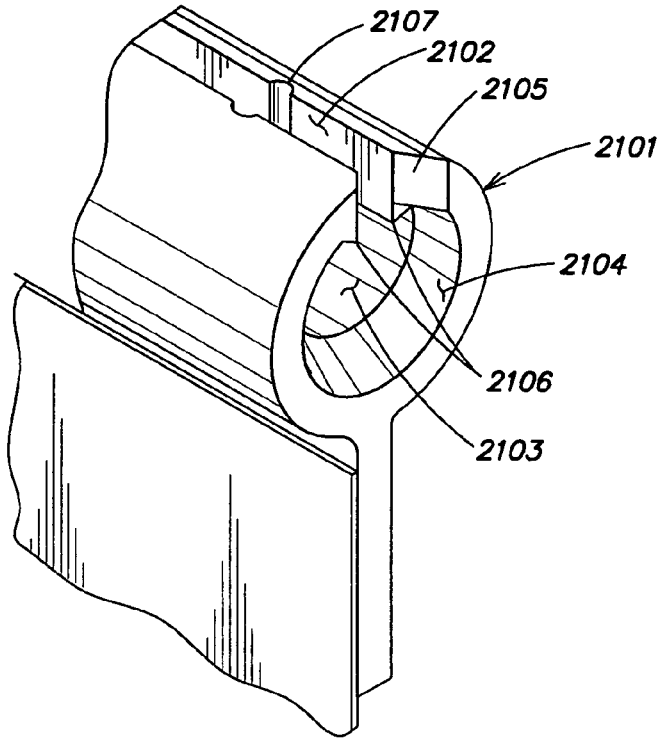
FIG. 21 is a perspective view of a detail of an open ended track with which tabs according to aspects of embodiments of the invention mate.

FIG. 21 shows a track 2101 having a slot 2102 and an internal passage 2103, both running the length of the track 2101 and which receive the tab (not shown). In this embodiment, the end of the internal passage 2103 includes a bevel 2104 and the end of the slot 2102 also includes a bevel 2105, whereby insertion of the tab into the track is facilitated. In some embodiments, the track may be left with open ends, as shown in FIG. 21. The internal passage 2103 may contain a retaining groove 2106 running the length of the internal passage. This may strengthen the channel and minimize the chance of the tab being pulled through the slot at the top of the rail.

Figure 22:
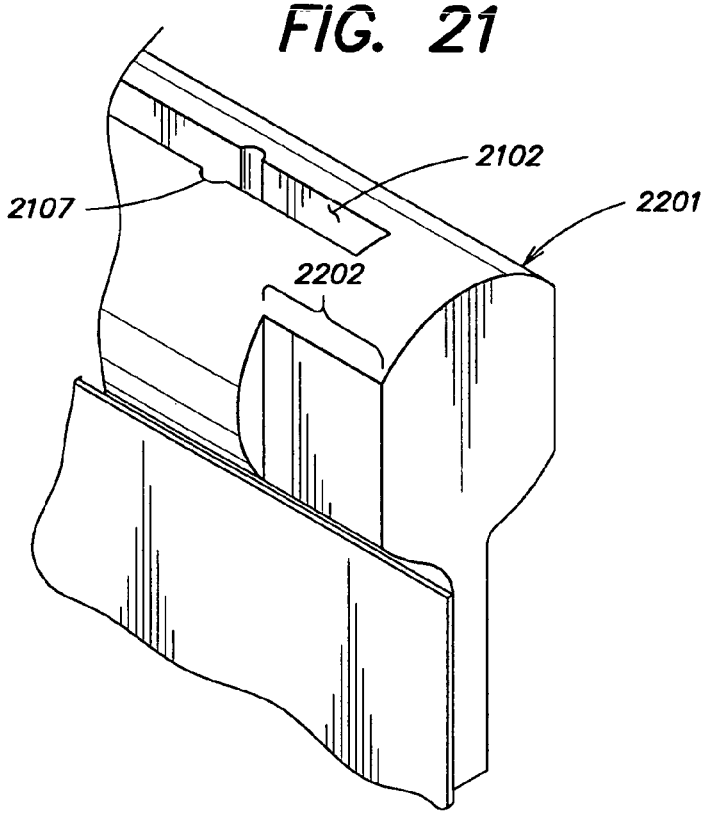
FIG. 22 is a perspective view of a detail of a closed ended track with which tabs according to aspects of embodiments of the invention mate.

In other embodiments, as shown in FIG. 22, the slot 2102 and internal passage (not shown) may be closed off at the end by a seal 2201. The seal 2201 may be formed by applying heat and pressure to form a pinched region 2202 as shown in FIG. 22, or alternatively the seal may be formed by inserting a plug (not shown) into the slot 2102 and for internal passage 2103 of the track 2101 of FIG. 21. Other seals may be applied either externally or internally to the track, as may be understood by skilled artisans.

Figure 23:
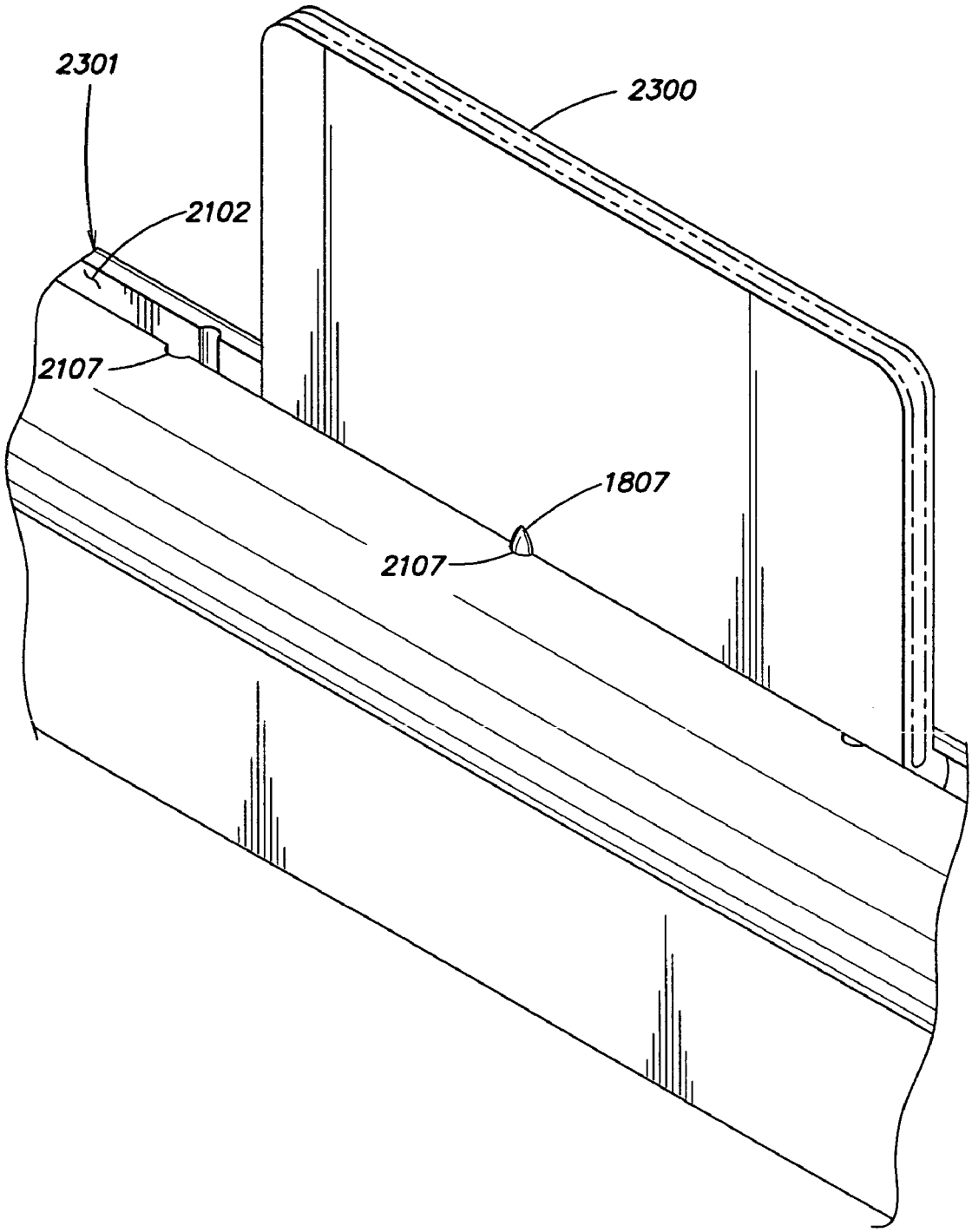
FIG. 23 is a perspective view of a detail of an assembly including one of the tracks of FIGS. 21 and 22 and one of the tabs of FIGS. 15, 16, 17, 18, 19 or 20.

As shown in FIG. 23, any of the embodiments of FIGS. 21 and 22 may also include detent features 2301 to engage with rib 1807 (FIG. 18). Tab 1501 may be positioned to any location along the track 2101, where it will be retained by a friction fit between rib 1807 and slot 2102, however, the tab will prefer locations where rib 1807 engages one of the detent features 2301, as shown.

Figure 24:
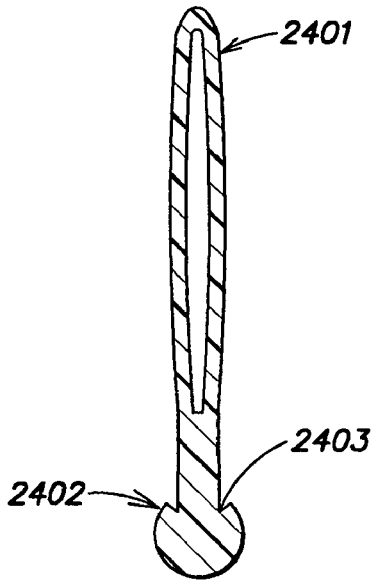
FIG. 24 is a cross sectional view of a closed hollow tab according to aspects of an embodiment of the invention.
Figure 25:
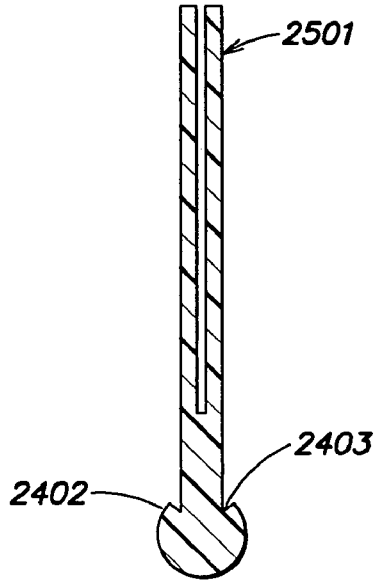
FIG. 25 is a perspective view of another bifurcated tab according to aspects of an embodiment of the invention.
Figure 26:
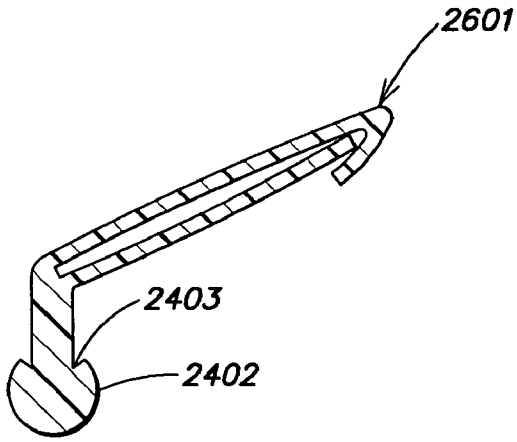
FIG. 26 is a cross sectional view of a closed hollow tab having a clip closure according to aspects of an embodiment of the invention.

FIGS. 24, 25 and 26 show further alternatives to the tabs of FIGS. 15, 16, 17, 18, 19 and 20.

FIG. 24 shows a tab 2401 similar to that of FIG. 20. In addition to the features described in connection with FIG. 20, this tab includes a rail 2402 having a retaining groove 2403. Retaining groove 2403 mats with an optional protruding edge (FIG. 21, 2106) having a corresponding profile formed in the internal passage 2103. The combination of retaining groove 2403 and protruding edge 2106 prevent the tab 2401 from pulling through the slot (FIG. 21, 2102) of the rail.

Tab 2501 of FIG. 25 and tab 2601 of FIG. 26 also include rail 2402 and retaining groove 2403 in combination with other tab structures previously discussed.

The rails of the tab shown in FIGS. 15, 16, 17, 18, 19 and 20 would fit internal passages lacking the optional protruding edge 2106.

Because the tabs can be extruded of a polymeric material and then cut to length, or alternatively molded of a polymeric material in addition to paper or card stock labels for insertion into the tab (FIGS. 15, 16, 17, 18, 19 and 20, for example), they are also compatible with peelable labels. The peelable labels can be provided in sheets for laser or inkjet printing. The tabs can also be provided with a textured surface suitable for accepting permanent marker inks or the like.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A stationery accessory system, comprising:

a slidable tab; and a sheet-like member including a rail;

the rail having a channel defined by a wall along a longitudinal aspect thereof, the channel having a longitudinal opening narrower than a width interior to the channel measured parallel to the longitudinal opening;

the slidable tab having an expanded edge, the expanded edge having a width greater than the longitudinal opening such that the channel and the expanded edge are slidably engageable, the tab further comprising a front wall, and a back wall, wherein the front wall and the back wall define a void for receiving a label, and wherein the front wall and the back wall are joined at both the top edge and the bottom edge; and the channel further defining an open tapered end whereby the expanded edge can be guided into the channel.

2. The system of claim 1, wherein the rail is integral with the sheet-like member.

3. The system of claim 1, wherein the rail is affixed to the sheet-like member.

4. The system of claim 1, wherein the rail and the slidable tab further include a beveled edge for facilitating cooperation thereof.

5. A stationery accessory system, comprising:

a slidable tab; and a sheet-like member including a rail;

the rail having a channel defined by a wall along a longitudinal aspect thereof, the channel having a longitudinal opening narrower than a width interior to the channel measured parallel to the longitudinal opening; and the slidable tab having an expanded edge, the expanded edge having a width greater than the longitudinal opening such that the channel and the expanded edge are slidably engageable, the tab further comprising a front wall, and a back wall, wherein the front wall and the back wall define a void for receiving a label and are joined at one of a top edge and a bottom edge, and wherein one of the front wall and the back wall includes a lip that that overlaps another one of the front wall or the back wall; and the channel further defining an open tapered end whereby the expanded edge can be guided into the channel.

6. The system of claim 5, wherein the rail is integral with the sheet-like member.

7. The system of claim 5, wherein the rail is affixed to the sheet-like member.

8. The system of claim 5, wherein the nil and the slidable tab further include a beveled edge for facilitating cooperation thereof.

9. A stationery accessory system, comprising:

a slidable tab; and a sheet-like member including a rail;

the rail having a channel defined by a wall along a longitudinal aspect thereof, the channel having a longitudinal opening narrower than a width interior to the channel measured parallel to the longitudinal opening; and the slidable tab having an expanded edge, the expanded edge having a width greater than the longitudinal opening such that the channel and the expanded edge are slidably engageable, and wherein the channel includes detent features and the expanded edge includes ribs that engage the detent features.

10. The system of claim 9, wherein the rail is integral with the sheet-like member.

11. The system of claim 9, wherein the rail is affixed to the sheet-like member.

12. The system of claim 9, wherein the channel is open at an end and is tapered at the open end, whereby the expanded edge can be guided into the channel.

13. The system of claim 9, wherein the rail and the slidable tab further include a beveled edge for facilitating cooperation thereof.

14. A stationery accessory system, comprising:

a slidable tab; and a sheet-like member including a rail;

the rail having a channel defined by a wall along a longitudinal aspect thereof, the channel having a longitudinal opening narrower than a width interior to the channel measured parallel to the longitudinal opening; and the slidable tab having an expanded edge, the expanded edge having a width greater than the longitudinal opening such that the channel and the expanded edge are slidably engageable, wherein the channel includes detent features and the expanded edge includes ribs that engage the detent features, and wherein the detent features are disposed in the longitudinal opening.

15. The system of claim 14, wherein the rail is integral with the sheet-like member.

16. The system of claim 14, wherein the rail is affixed to the sheet-like member.

17. The system of claim 14, wherein the channel is open at an end and is tapered at the open end, whereby the expanded edge can be guided into the channel.

18. The system of claim 14, wherein the rail and the slidable tab further include a beveled edge for facilitating cooperation thereof.

19. A stationery accessory system, comprising:

a slidable tab; and a sheet-like member including a rail;

the rail having a channel defined by a wall along a longitudinal aspect thereof, the channel having a longitudinal opening narrower than a width interior to the channel measured parallel to the longitudinal opening; and the slidable tab having an expanded edge, the expanded edge having a width greater than the longitudinal opening such that the channel and the expanded edge are slidably engageable, wherein the channel includes detent features and the expanded edge includes ribs that engage the detent features, and wherein the detent features are slots intermittently spaced along the longitudinal opening and the ribs fit into the slots when the tab is disposed at predetermined longitudinal positions.

20. The system of claim 19, wherein the rail is integral with the sheet-like member.

21. The system of claim 19, wherein the rail is affixed to the sheet-like member.

22. The system of claim 19, wherein the channel is open at an end and is tapered at the open end, whereby the expanded edge can be guided into the channel.

23. The system of claim 19, wherein the rail and the slidable tab further include a beveled edge for facilitating cooperation thereof.

* * * * *